US010332450B2

(12) United States Patent
Ota et al.

(10) Patent No.: US 10,332,450 B2
(45) Date of Patent: Jun. 25, 2019

(54) ELECTRO-OPTICAL DEVICE, ELECTRONIC APPARATUS, AND METHOD OF DRIVING ELECTRO-OPTICAL DEVICE

(71) Applicant: SEIKO EPSON CORPORATION, Tokyo (JP)

(72) Inventors: Hitoshi Ota, Shiojiri (JP); Takeshi Koshihara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/105,401

(22) Filed: Aug. 20, 2018

(65) Prior Publication Data

US 2018/0357957 A1 Dec. 13, 2018

Related U.S. Application Data

(62) Division of application No. 14/806,118, filed on Jul. 22, 2015, now Pat. No. 10,152,919.

(30) Foreign Application Priority Data

Aug. 6, 2014 (JP) ..... 2014-160135

(51) Int. Cl.

| | |
|---|---|
| ***G09G 3/00*** | (2006.01) |
| ***G09G 3/3233*** | (2016.01) |
| ***G09G 3/3291*** | (2016.01) |

(52) U.S. Cl.

CPC ..... *G09G 3/3233* (2013.01); *G09G 3/003* (2013.01); *G09G 3/3291* (2013.01); *G09G 2300/0819* (2013.01); *G09G 2300/0842* (2013.01); *G09G 2300/0861* (2013.01); *G09G 2310/0251* (2013.01); *G09G 2320/043* (2013.01); *G09G 2320/045* (2013.01)

(58) Field of Classification Search

None

See application file for complete search history.

(56) References Cited

U.S. PATENT DOCUMENTS

| | | | |
|---|---|---|---|
| 6,825,836 | B1 | 11/2004 | Stewart et al. |
| 2003/0107560 | A1 | 6/2003 | Yumoto et al. |

(Continued)

FOREIGN PATENT DOCUMENTS

| | | | |
|---|---|---|---|
| CN | 103597534 | A | 2/2014 |
| JP | 2009-300752 | A | 12/2009 |
| TW | 201344899 | A | 11/2013 |

OTHER PUBLICATIONS

Nov. 1, 2017 Office Action issued in U.S. Appl. No. 14/806,118.
Jan. 18, 2018 Office Action issued in U.S. Appl. No. 14/806,118.

*Primary Examiner* — Amare Mengistu
*Assistant Examiner* — Sarvesh J Nadkarni
(74) *Attorney, Agent, or Firm* — Oliff PLC

(57) ABSTRACT

An electro-optical device includes a first data transfer line that intersects a scan line, a second data transfer line, a first transistor that controls coupling between the first data transfer line and the second transfer line. The two or more second data transfer lines are respectively coupled to the first data transfer line via first capacitors, and when a collection of pixel circuits that are coupled to the same first data transfer line via the second data transfer lines is referred to as a pixel string, the second data transfer lines are provided to pixel circuits less than the pixel circuits included in the pixel string.

4 Claims, 13 Drawing Sheets

(56) References Cited

U.S. PATENT DOCUMENTS

| | | | | |
|---|---|---|---|---|
| 2003/0184370 | A1 | 10/2003 | Kimura | |
| 2010/0045646 | A1 | 2/2010 | Kishi | |
| 2011/0050741 | A1 | 3/2011 | Jeong | |
| 2013/0093737 | A1 | 4/2013 | Ota et al. | |
| 2013/0099692 | A1 | 4/2013 | Chaji et al. | |
| 2013/0100173 | A1 | 4/2013 | Chaji et al. | |
| 2013/0207564 | A1* | 8/2013 | Ota ..... | H05B 37/02 315/224 |
| 2013/0286054 | A1 | 10/2013 | Kitadani et al. | |
| 2016/0055804 | A1 | 2/2016 | Kitadani et al. | |
| 2016/0260386 | A1 | 9/2016 | Kitadani et al. | |
| 2016/0329017 | A1 | 11/2016 | Chaji et al. | |
| 2018/0033368 | A1 | 2/2018 | Chaji et al. | |
| 2018/0204541 | A1 | 7/2018 | Chaji et al. | |

* cited by examiner

COMPARISON EXAMPLE

ELECTRO-OPTICAL DEVICE, ELECTRONIC APPARATUS, AND METHOD OF DRIVING ELECTRO-OPTICAL DEVICE

This application is a Divisional of application Ser. No. 14/806,118, filed on Jul. 22, 2015, which is based on and claims priority under 35 U.S.C. 119 from Japanese Patent Application No. 2014-160135, filed Aug. 6, 2014, the entire contents of which are incorporated herein by reference.

BACKGROUND

1. Technical Field

The present invention relates to an electro-optical device, an electronic apparatus, and a method of driving the electro-optical device.

2. Related Art

In recent years, various electro-optical devices that use a light emitting element such as an organic light emitting diode (hereinafter, referred to as OLED) have been proposed. In a general configuration of the electro-optical device, an image circuit that includes a light emitting element, a transistor, or the like is provided in correspondence with pixels of an image to be displayed, corresponding to intersection of scan lines and data lines.

In the configuration, if a data signal of a potential according to a gradation level of pixels is applied to a gate of the transistor, the transistor supplies a light emitting element with a current according to a gate-source voltage. According to this, the light emitting element emits light in brightness according to a gradation level.

In a driving method that uses a transistor to adjust a light emission intensity, if threshold voltages of transistors provided in each pixel vary, a current that flows through a light emitting element varies, and thereby image quality of a display image is decreased. Thus, in order to prevent image quality from decreasing, it is necessary to compensate for variation of the threshold voltage of a transistor. A period in which an operation (hereinafter, referred to as a compensation operation) with regard to the compensation is performed is referred to as a compensation period. In the compensation period, a drain and a gate of the transistor are coupled to a supplying line of a data signal that is provided in each column, and the potential is set to a value according to a threshold voltage of the transistor for example, JP-A-2013-88611).

However, since a parasitic capacitor accompanies a supplying line of a data signal, charging or discharging of the parasitic capacitor is performed when a compensation operation is performed. Then, a compensation period is lengthened by an amount of time required for charging or discharging the parasitic capacitor. In addition, if a compensation period is set without taking into account time required for charging or discharging the parasitic capacitor that accompanies the supplying line, compensation in the compensation period becomes insufficient.

SUMMARY

An advantage of some aspects of the invention is that speed-up of a compensation operation of compensating for variation of a threshold voltage of a transistor which is used for adjusting a light emission intensity is realized.

According to an aspect of the invention, there is provided an electro-optical device including a scan line; a first data transfer line; a second data transfer line; a first capacitor that includes a first electrode which is coupled to the first data transfer line, and a second electrode which is coupled to the second data transfer line; a first transistor that couples or decouples the first data transfer line to or from the second data transfer line; a pixel circuit that is provided in correspondence with the second data transfer line and the scan line; and a drive circuit that drives the pixel circuit, in which the pixel circuit includes a drive transistor that has a gate electrode, a first current terminal, and a second current terminal; a second transistor that is coupled between the second data transfer line and the gate electrode of the drive transistor; a third transistor that couples the first current terminal of the drive transistor to the gate electrode of the drive transistor; and a light emitting element that emits light in brightness according to a magnitude of a current that is supplied via the drive transistor, in which the drive circuit couples the first data transfer line to the second data transfer line by turning on the first transistor, and supplies the second data transfer line with an initial potential by turning off the second transistor and the third transistor, in a first period, in which the drive circuit decouples the second data transfer line from the first data transfer line by turning off the first transistor, and couples the first current terminal of the drive transistor to the gate electrode of the drive transistor by turning on the second transistor and the third transistor, in a second period following the first period, and in which the two or more second data transfer lines are respectively coupled to the first data transfer line via the first capacitors, and if a collection of the pixel circuits that are coupled to the same first data transfer line via the second data transfer lines is referred to as a pixel string, the second data transfer lines are provided to the pixel circuits less than the pixel circuits included in the pixel string.

According to the aspect, the second period (compensation period) is reduced by the following reason, compared to a configuration of the related art. Here, a collection of the pixel circuits that are coupled to the same first data transfer line via the second data transfer line and the first capacitor (transfer capacitor) is referred to as a "pixel string", and a collection of the pixel circuits that are coupled to the same second data transfer line is referred to as a "block". According to the aspect, the second data transfer lines are provided in the pixel circuits less than the pixel circuits included in the pixel string. In contrast to this, in the configuration of the related art, one first data transfer line and one second data transfer line are provided in one pixel string (all the pixel circuits included in one pixel string). Thus, the second data transfer lines is short, compared to the configuration of the related art. According to this, a time required for charging or discharging the second data transfer line is reduced. That is, compared to the configuration of the related art, a time required for charging or discharging a parasitic capacitor accompanying the second data transfer line is reduced, and thereby the second period (compensation period) is reduced.

The electro-optical device according to another aspect may include a fourth transistor that is coupled between the first current terminal of the drive transistor and the light emitting element. According to the aspect, the fourth transistor functions as a switching transistor that controls electrical coupling between the drive transistor and the light emitting element.

The electro-optical device according to still another aspect may include a fifth transistor that is coupled between a reset potential supplying line which supplies a reset potential to the light emitting element, and the light emitting element. According to the aspect, the fifth transistor functions as a switching transistor that controls electrical coupling between the reset potential supplying line and the light emitting element.

The electro-optical device according to still another aspect may include the drive circuit which couples a second capacitor that turns off the first transistor and the third transistor, turns on the second transistor, and retains a data signal according to a designated gradation, to the first data transfer line in a third period following the second period. According to the aspect, in the third period (writing period), the data signal according to the designated gradation of each pixel is supplied to a pixel circuit via a first data transfer line.

According to still another aspect, there is provided an electro-optical device including a first data transfer line; a second data transfer line; a first capacitor that includes a first electrode which is coupled to the first data transfer line, and a second electrode which is coupled to the second data transfer line; a drive transistor; a compensation unit that outputs a potential according to electrical characteristics of the drive transistor to the second electrode and the second data transfer line; a data transfer line driver circuit that switches potentials of the data transfer line and the first electrode, in such a manner that potential change amounts of the data transfer line and the first electrode becomes a value according to a gradation level; and a light emitting element that emits light in brightness according to a magnitude of a current which is supplied based on a potential that is shifted in accordance with the potential change amounts from a potential according to the electrical characteristics of the drive transistor, in which the first data transfer line is provided in correspondence with M pixels, and in which the second data transfer line is divided into K pieces that are values obtained by dividing M by Nb, and Nb pixels are coupled to one second data transfer line.

According to the aspect, the second data transfer lines of K pieces that are values obtained by dividing M by Nb are provided in one first data transfer line. In addition, the first data transfer line is provided in correspondence with the pixel circuits of an amount of M rows (M pieces), and the second transfer line is provided in correspondence with the pixel circuits of an amount of Nb rows (Nb pieces) less than the M rows. Thus, the second data transfer line is shorter than the first data transfer line. According to this, a time required for charging or discharging the second data transfer line is reduced. Thus, compared to the configuration of the related art, a time required for charging or discharging the parasitic capacitor accompanying the second transfer line is reduced and thereby a compensation period is reduced.

According to still another aspect of the invention, there is provided an electronic apparatus including the electro-optical device according to any one of the respective aspects. According to the aspect, an electronic apparatus that includes the electro-optical device according to any one of the respective aspects is provided.

According to still another aspect of the invention, there is provided a method of driving an electro-optical device which includes a scan line; a first data transfer line that intersects the scan line; a second data transfer line; a first capacitor that includes a first electrode which is coupled to the first data transfer line, and a second electrode which is coupled to the second data transfer line; a first transistor that couples or decouples the first data transfer line to or from the second data transfer line; and a pixel circuit that is provided in correspondence with the second data transfer line and the scan line, wherein the pixel circuit includes, a drive transistor that has a gate electrode, a first current terminal, and a second current terminal; a second transistor that is coupled between the second data transfer line and the gate electrode of the drive transistor; a third transistor that couples the first current terminal of the drive transistor to the gate electrode of the drive transistor; and a light emitting element that emits light in brightness according to a magnitude of a current that is supplied via the drive transistor, and wherein the two or more second data transfer lines are respectively coupled to the first data transfer line via the first capacitors, and if a collection of the pixel circuits that are coupled to the same first data transfer line via the second data transfer lines is referred to as a pixel string, the second data transfer lines are provided to the pixel circuits less than the pixel circuits included in the pixel string, the method comprising: coupling the first data transfer line to the second data transfer line by turning on the first transistor, and supplying the second data transfer line with an initial potential by turning off the second transistor and the third transistor, in a first period; and decoupling the second data transfer line from the first data transfer line by turning off the first transistor, and coupling the first current terminal of the drive transistor to the gate electrode of the drive transistor by turning on the second transistor and the third transistor, in a second period following the first period.

According to the aspect, the second period (compensation period) is reduced by the following reason, compared to a configuration of the related art. Here, a collection of the pixel circuits that are coupled to the same first data transfer line via the second data transfer line and the first capacitor (transfer capacitor) is referred to as a "pixel string", and a collection of the pixel circuits that are coupled to the same second data transfer line is referred to as a "block". According to the aspect, the second data transfer lines are provided in the pixel circuits less than the pixel circuits included in the pixel string. In contrast to this, in the configuration of the related art, one first data transfer line and one second data transfer line are provided in one pixel string (all the pixel circuits included in one pixel string). Thus, the second data transfer lines is short, compared to the configuration of the related art. According to this, a time required for charging or discharging the second data transfer line is reduced. That is, compared to the configuration of the related art, a time required for charging or discharging a parasitic capacitor accompanying the second data transfer line is reduced, and thereby the second period (compensation period) is reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
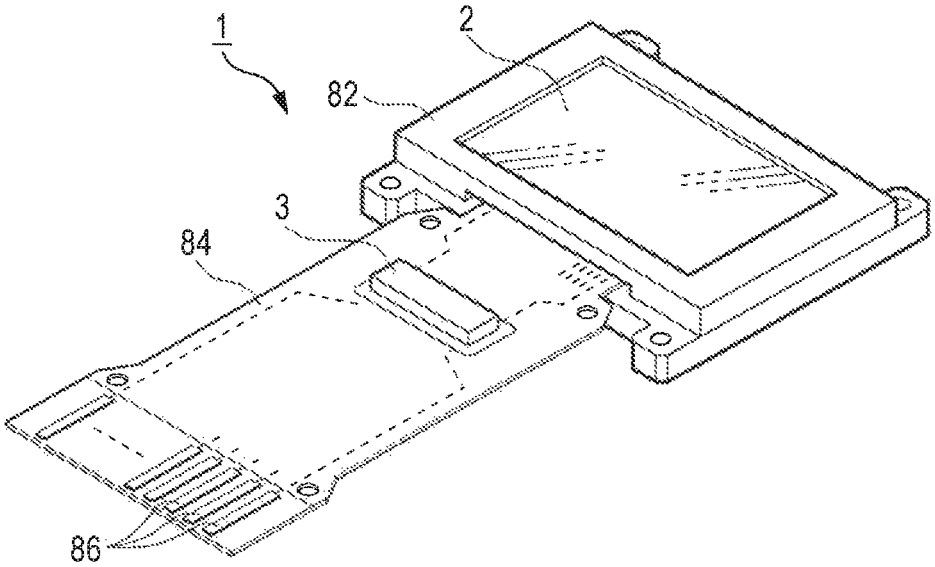
FIG. 1 is a perspective diagram illustrating a configuration of an electro-optical device according to an embodiment of the invention.

FIG. 1 is a perspective diagram illustrating a configuration of an electro-optical device 1 according to an embodiment of the invention. For example, the electro-optical device 1 is a micro display which displays an image in a head-mounted display.

As illustrated in FIG. 1, the electro-optical device 1 includes a display panel 2, and a control circuit 3 that controls an operation of the display panel 2. The display panel 2 includes a plurality of pixel circuits, and a drive circuit that drives the pixel circuit. In the present embodiment, the plurality of pixel circuits and the drive circuit that are included in the display panel 2 are formed on a silicon substrate, and an OLED that is an example of a light emitting element is used for the pixel circuits. In addition, for example, the display panel 2 is contained in a case 82 of a frame shape that is opened in a display unit, and is coupled to one end of a flexible printed circuit (FPC) substrate 84.

On the FPC substrate 84, the control circuit 3 of a semiconductor chip is mounted using a chip On Film (COF) technology, a plurality of terminals 86 is provided, and the plurality of terminals 86 is coupled to an upper circuit that is not illustrated.

Figure 2:
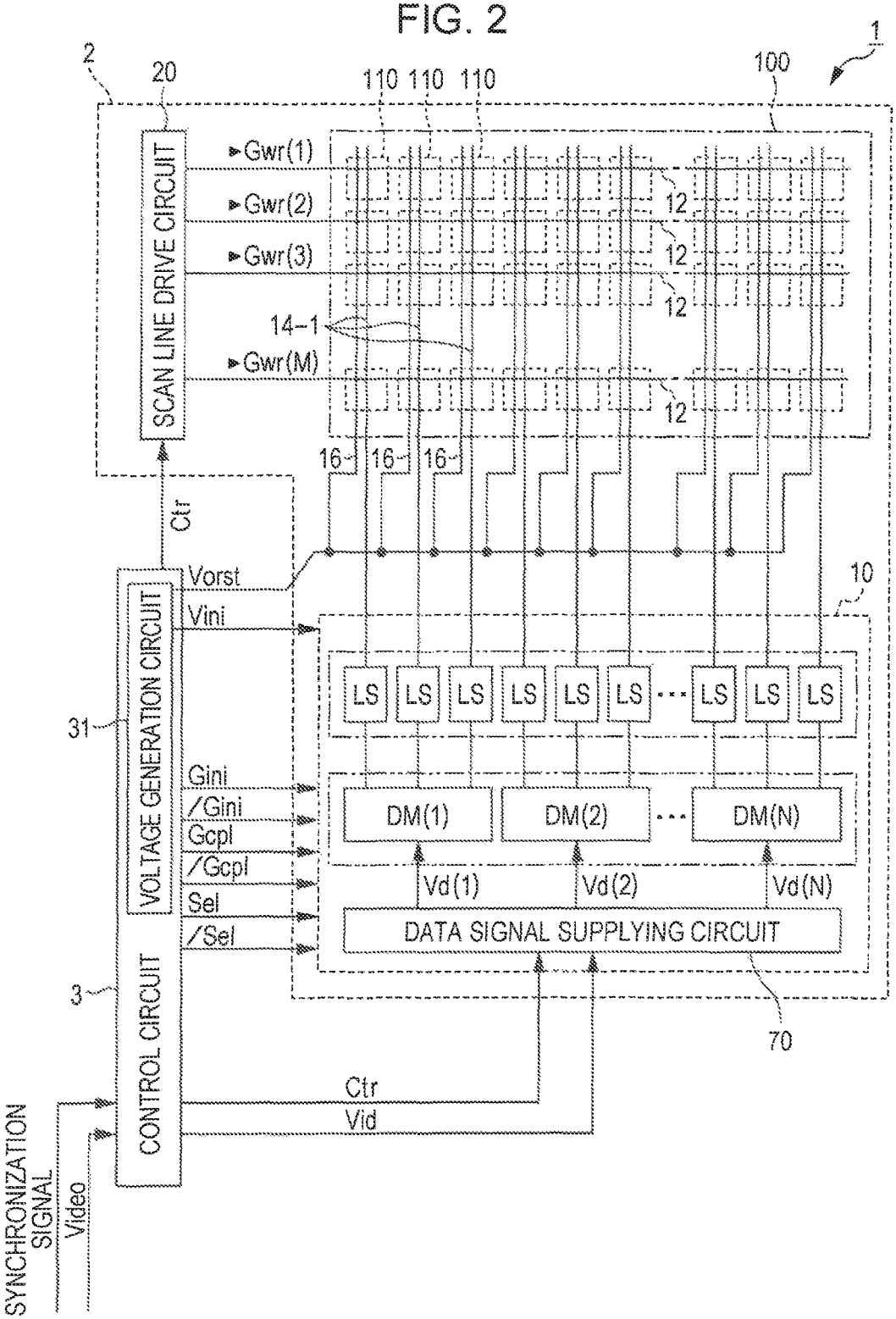
FIG. 2 is a block diagram illustrating a configuration of the electro-optical device.

FIG. 2 is a block diagram illustrating a configuration of the electro-optical device 1 according to the present embodiment. As described above, the electro-optical device 1 includes the display panel 2 and the control circuit 3.

Digital image data Video is supplied to the control circuit 3 from an upper circuit that is not illustrated in synchronization with a synchronization signal. Here, the image data Video is data in which a gray scale level of a pixel of an image to be displayed by the display panel 2 (strictly speaking, a display unit 100 that will be described later) is specified in, for example, eight bits. In addition, a synchronization signal is a signal that includes a vertical synchronization signal, a horizontal synchronization signal, and a dot clock signal.

The control circuit 3 generates various control signals based on a synchronization signal, and supplies the display panel 2 with the various control signals. Specifically, the control circuit 3 supplies the display panel 2 with a control signal Ctr, a control signal Gini with a positive logic, a control signal /Gini with a negative logic which is in a relationship of a logic opposite to the logic of the control signal Gini, a control signal Gcpl with a positive logic, a control signal /Gcpl with a negative logic which is in a relationship of a logic opposite to the logic of the control signal Gcpl, control signals Sel(1), Sel(2), and Sel(3), and control signals /Sel(1), /Sel(2), and /Sel(3) which are in a relationship of a logic opposite to the logic of the control signals Sel(1), Sel(2), and Sel(3).

Here, the control signal Ctr is a signal that includes a plurality of signals, such as a pulse signal, a clock signal, and an enable signal.

There is a case in which the control signals Sel(1), Sel(2), and Sel(3) are comprehensively referred to as a control signal Sel, and the control signals /Sel(1), /Sel(2), and /Sel(3) are comprehensively referred to as a control signal /Sel.

In addition, the control circuit 3 includes a voltage generation circuit 31. The voltage generation circuit 31 supplies the display panel 2 with various potentials. Specifically, the control circuit 3 supplies the display panel 2 with a reset potential Vorst, an initial potential Vini, and the like.

Furthermore, the control circuit 3 generates an analog image signal Vid based on the image data Video. Specifically, a potential which is represented by the image signal Vid, and a look-up table that is stored in association with brightness of a light emitting element (OLED 130 which will be described later) which is included in the display panel 2 are provided to the control circuit 3. Then, the control circuit 3 generates the image signal Vid that represents a potential corresponding to the brightness of a light emitting element which is defined in the image data Video by referring to the look-up table, and supplies the display panel 2 with the image signal Vid.

As illustrated in FIG. 2, the display panel 2 includes the display unit 100, and a drive circuit (a data transfer line drive circuit 10 and a scan line drive circuit 20).

In the display unit 100, pixel circuits 110 that correspond to the pixels of an image to be displayed are arranged in a matrix. In detail, in the display unit 100, scan lines 12 of M rows are provided so as to extend in a horizontal direction (X direction) in the figure, and in addition, first data transfer lines 14-1 of (3N) columns that are grouped for each of three columns extend in a vertical direction (Y direction) in the figure and are provided so as to have an electrical insulation with the respective scan lines 12.

Figure 4:
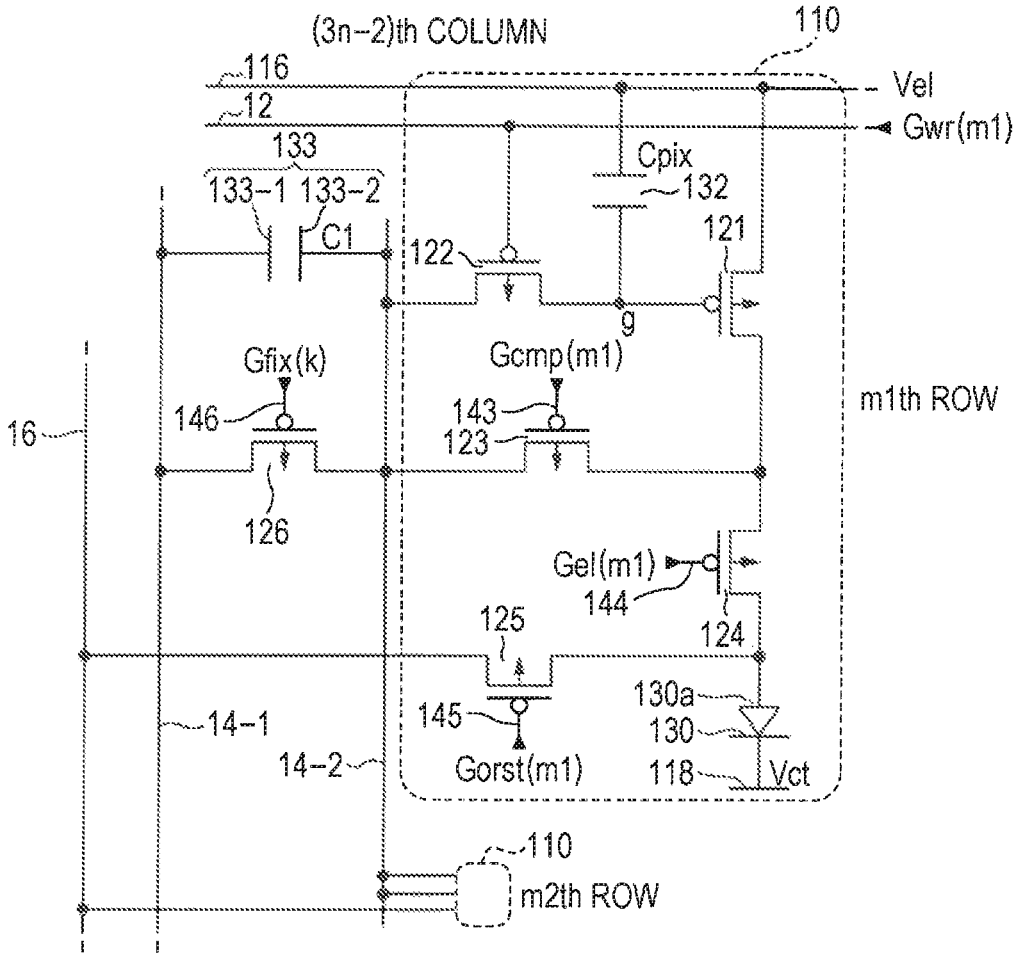
FIG. 4 is a circuit diagram illustrating a configuration of a pixel circuit of the electro-optical device.

While not illustrated in FIG. 2, but in order to avoid complexity of the figure, second data transfer lines 14-2 can be electrically coupled to the first respective data transfer lines 14-1 and are provided so as to extend in a vertical direction (Y direction) (for example, refer to FIG. 4). Then, pixel circuits 110 are provided in correspondence with the scan lines 12 of M rows and the second data transfer lines 14-2 of (3N) columns. For this reason, in the present embodiment, the pixel circuits 110 are arranged in a matrix of vertical M columns×horizontal (3N) columns.

Here, both M and N are natural numbers. In order to distinguish rows from the matrix of the scan lines 12 and the pixel circuits 110, there is a case of being referred to as a first row, a second row, a third row, . . . , an (M−1)th row, and an Mth row, sequentially from top in the figure. In the same manner, in order to distinguish columns from the matrix of the first data transfer lines 14-1 and the pixel circuits 110, there is a case of being referred to as a first column, a second column, a third column, . . . , a (3N−1)th column, and a (3N)th column, sequentially from the left in the figure.

Here, it is assumed that, in order to generally describe groups of the first data transfer lines 14-1, if one or more arbitrary integer is referred to as n, the first data transfer lines 14-1 of a (3n−2)th column, a (3n−1)th column, and a (3n)th column belongs to an nth group when counted from the left.

The three pixel circuits 110 that correspond to the scan lines 12 in the same row and the second data transfer lines 14-2 of three columns which belongs to the same group respectively correspond to pixels of R (red), G (green), and B (blue), and then represent one dot of a color image which will be displayed by the three pixels. That is, the present embodiment is configured in such a manner that the color of one dot is represented using additive color mixing according to light emission of an OLED corresponding to RGB.

In addition, as illustrated in FIG. 2, in the display unit 100, power supplying lines (reset potential supplying lines) 16 of the (3N) columns are provided so as to extend to in a vertical direction and to have electrical insulation with the respective scan lines 12. A predetermined reset potential Vorst is commonly supplied to the respective power supplying line 16. Here, in order to distinguish the columns of the power supplying lines 16, there is a case of being referred to as power supplying lines 16 of a first column, a second column, a third column, . . . , and a (3N)th column. Each of the power supplying lines 16 of the first to (3N)th columns is provided so as to correspond to each of the first data transfer lines 14-1 (second data transfer lines 14-2) of the first to (3N)th columns.

The scan line drive circuit 20 generates scan signals Gwr for sequentially scanning M scan lines 12 for each row during one frame, according to a control signal Ctr. Here, the scan signals Gwr which are supplied to the scan lines 12 of the first column, the second column, the third column, . . . , and the Mth column are respectively referred to as Gwr(1), Gwr(2), Gwr(3), . . . , Gwr(M−1), and Gwr(M).

The scan line drive circuit 20 generates various control signals which are synchronous to the scan signals Gwr for each row and supplies the display unit 100 with the signals, in addition to the scan signals Gwr(1) to Gwr(M), while not illustrated in FIG. 2. In addition, a frame means a period that the electro-optical device 1 needs so as to display an image with an amount of one cut (frame), and is a period of 8.3 milliseconds of one period, if a frequency of a vertical synchronization signal which is included in a synchronization signal is 120 Hz, for example.

The data transfer line drive circuit 10 includes (3N) level shift circuits LS that are provided so as to correspond one-to-one to each of the first data transfer lines 14-1 of the (3N)th column, N demultiplexers DM which are provided in each of the first data transfer lines 14-1 of three columns that configure each group, and a data signal supplying circuit 70.

The data signal supplying circuit 70 generates data signals Vd(1), Vd(2), . . . , and Vd(N), based on the image signal Vid which is supplied by the control circuit 3, and the control signal Ctr. That is, the data signal supplying circuit 70 generates the data signals Vd(1), Vd(2), . . . , and Vd(N), based on the image signal Vid which is obtained by performing time-division multiplexing of the data signals Vd(1), Vd(2), . . . , and Vd(N). Then, the data signal supplying circuit 70 respectively supplies the demultiplexers DM corresponding to a first group, a second group, . . . , and an Nth group with the data signals Vd(1), Vd(2), . . . , and Vd(N).

Figure 3:
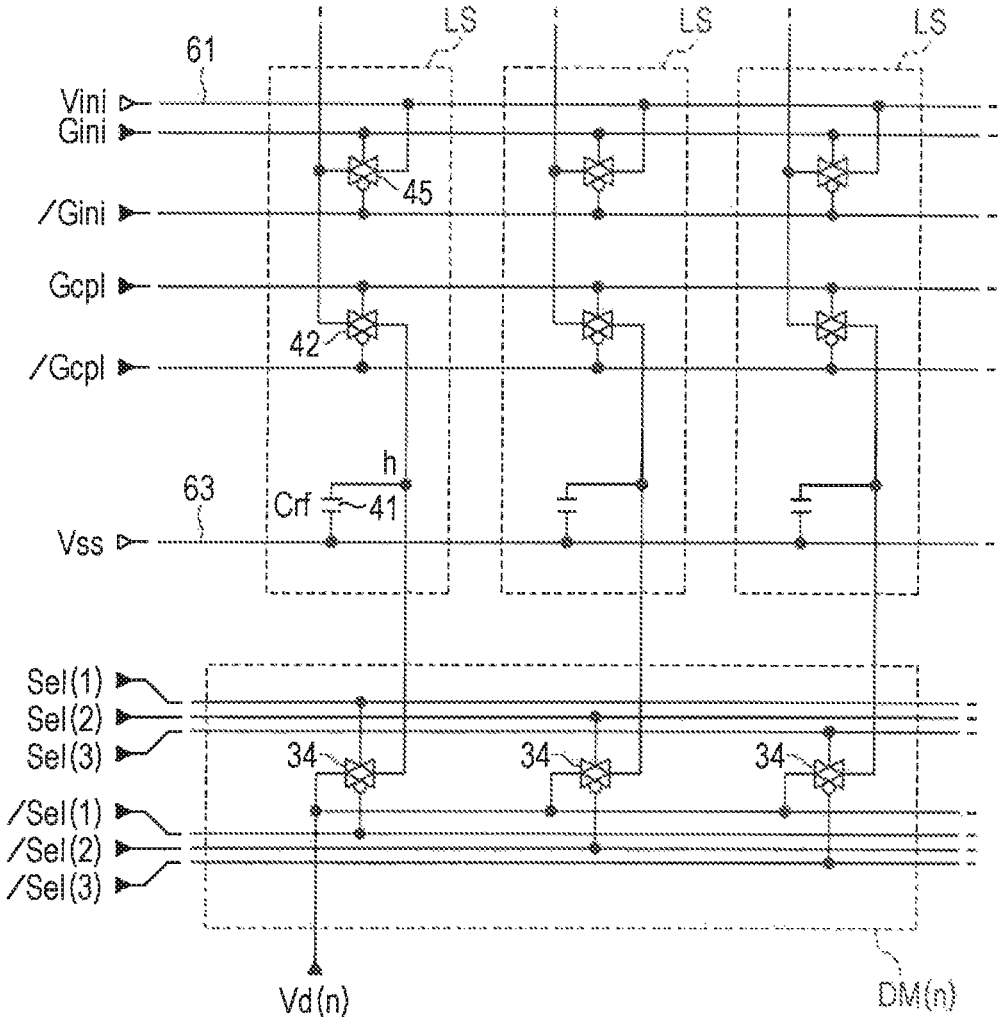
FIG. 3 is a circuit diagram illustrating configurations of a demultiplexer and a level shift circuit of the electro-optical device.

FIG. 3 is a circuit diagram illustrating configurations of the demultiplexer DM and the level shift circuit LS. FIG. 3 representatively illustrates the demultiplexer DM which belongs to the nth group, and the three level shift circuits LS which are coupled to the demultiplexer DM. Hereinafter, there a case in which the demultiplexer DM that belongs to the nth group is referred to as DM(n).

Hereinafter, the configurations of the demultiplexer DM and the level shift circuit LS will be described with reference to FIG. 3 in addition to FIG. 2.

As illustrated in FIG. 3, the demultiplexer DM is a collection of transmission gates 34 which are provided in each column, and sequentially supplies the data signals to three columns that configure the respective groups. Here, input terminals of the transmission gates 34 corresponding to the (3n−2)th column, the (3n−1)th column, and the (3n)th column which belong to the nth group are commonly coupled to each other, and the data signals Vd(n) are respectively supplied to the common terminals. The transmission gate 34 that is provided in the (3n−2)th column which is a left end column in the nth group is turned on (conducted) when a control signal Sel(1) is at an H level (when a control signal /Sel(1) is in an L level). In the same manner, the transmission gate 34 that is provided in the (3n−1)th column which is a central column in the nth group is turned on when a control signal Sel(2) is in an H level (when a control signal /Sel(2) is in an L level), and the transmission gate 34 that is provided in the (3n)th column which is a right end column in the nth group is turned on when a control signal Sel(3) is in an H level (when a control signal /Sel(3) is in an L level).

The level shift circuit LS includes a set of a retention capacitor (second capacitor) 41, a transmission gate 45, and a transmission gate 42 for each column, and shifts a potential of the data signal that is output from an output terminal of the transmission gate 34 of each column.

A source or a drain of the transmission gate 45 of each column is electrically coupled to the first data transfer line 14-1. In addition, the control circuit 3 commonly supplies a gate of the transmission gate 45 of each column with a control signal /Gini. The transmission gate 45 electrically couples the first data transfer line 14-1 to a supplying line of an initial potential Vini, when the control signal /Gini is in an L level, and electrically decouples the first data transfer line 14-1 from the supplying line, when the control signal /Gini is in an H level. A predetermined initial potential Vini is supplied to a supplying line 61 of the initial potential Vini from the control circuit 3.

The retention capacitor 41 includes two electrodes. One electrode of the retention capacitor 41 is electrically coupled to an input terminal of the transmission gate 42 via a node h. In addition, an output terminal of the transmission gate 42 is electrically coupled to the first data transfer line 14-1.

The control circuit 3 commonly supplies the transmission gates 42 of each column with the control signal Gcpl and the control signal /Gcpl. For this reason, the transmission gates 42 of each column are simultaneously turned on when the control signal Gcpl is in an H level (the control signal /Gcpl is in an L level).

One electrode of the retention capacitors 41 of each retention capacitor is electrically coupled to output terminals of the transmission gates 34 and input terminals of the transmission gates 42. Then, when the transmission gate 34 is turned on, the data signal Vd(n) is supplied to the one electrode of the retention capacitor 41 via the output terminal of the transmission gate 34. That is, the data signal Vd(n) is supplied to the one electrode of the retention capacitor 41.

In addition, the other electrodes of the retention capacitors 41 of each column are commonly coupled to the power supplying line 63 to which a potential Vss that is a fixed potential is supplied. Here, the potential Vss may be a potential corresponding to an L level of the scan signal and the control signal which are logic signals. A capacitance value of the retention capacitor 41 is referred to as Crf.

The pixel circuit 110 or the like will be described with reference to FIG. 4. In order to generally represent a row on which the pixel circuits 110 are arranged, an arbitrary integer which is equal to or greater than 1 and equal to or less than M is referred to as m. In addition, arbitrary integers which are equal to or greater than 1, equal to or less than M, and consecutive are referred to as m1 and m2. That is, m has a generalized concept that includes m1 or m2.

From an electrical viewpoint, the respective pixel circuits 110 are configured in the same manner as each other, thus being positioned in the mth row, and in the (3n−2)th column of the left end column of the nth group, here. The pixel circuit 110 in the mth row and the (3n−2)th column will be described as an example.

As illustrated in FIG. 4, a first electrode 133-1 of a transfer capacitor (first capacitor) 133 and one of a source and a drain of a first transistor 126 are electrically coupled to the first data transfer line 14-1. In addition, a second electrode 133-2 of the transfer capacitor 133 and the other of the source and the drain of the first transistor 126 are electrically coupled to the second data transfer line 14-2.

That is, the transfer capacitor 133 and the first transistor 126 are coupled in parallel with each other between the first data transfer line 14-1 and the second data transfer line 14-2.

In addition, the pixel circuit 110 is coupled to the second data transfer line 14-2. That is, a gradation potential is supplied to the pixel circuit 110 according to a designated gradation via the first data transfer line 14-1 and the second data transfer line 14-2.

Specifically, Nb pixel circuits 110 are electrically coupled to the second data transfer line 14-2. In the present embodiment, Nb is 2, and as illustrated in FIG. 4, the pixel circuit 110 of m1th row and the pixel circuit 110 of m2th row are coupled to the second data transfer line 14-2.

That is, in the present embodiment, two pixel circuits 110 commonly uses one second data transfer line 14-2, one transfer capacitor 133, and the first transistor 126.

Here, the number (Nb) of the pixel circuits 110 which are coupled to one second data transfer line 14-2 is not limited to two, and may be equal to or greater than one. Items to be considered at the time of determining Nb will be described later.

Figure 5:
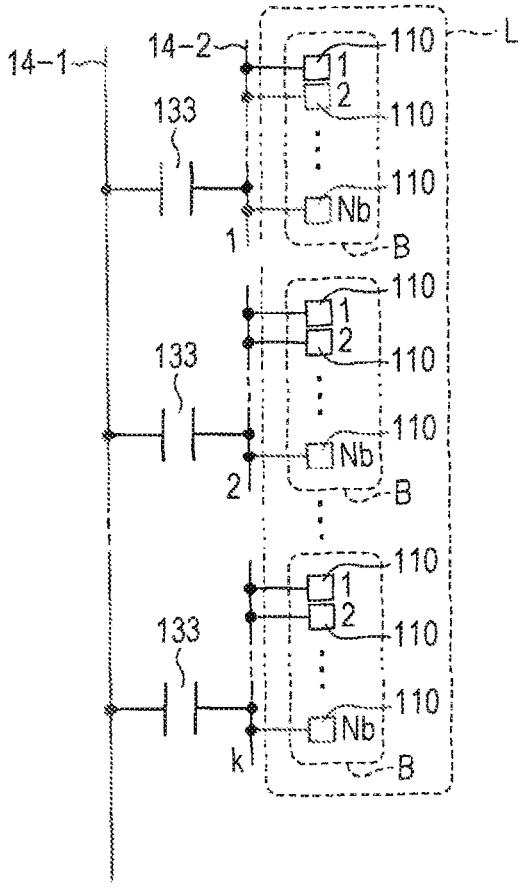
FIG. 5 is a diagram illustrating a specific configuration of the electro-optical device.

FIG. 5 is a diagram illustrating a specific configuration according to the present embodiment. In the present embodiment, as illustrated in FIG. 5, the second data transfer lines 14-2 which are equal to or more than two pieces are respectively coupled to the first data transfer line 14-1 via the transfer capacitors 133.

Here, a collection of the pixel circuits 110 which are coupled to the same first data transfer line 14-1 via the second data transfer lines 14-2 and the transfer capacitors 133 is referred to as a "pixel string" (pixel string L in FIG. 5). In addition, a collection of the pixel circuits 110 which are coupled to the same second data transfer line 14-2 is referred to as a "block" (block B in FIG. 5).

As illustrated in FIG. 5, the pixel string L includes a plurality of blocks B, and each block B includes a plurality of pixel circuits 110. That is, in the present embodiment, the second data transfer lines 14-2 are supplied to the pixel circuits 110 which are less than the pixel circuits 110 that are included in the pixel string L.

Figure 6:
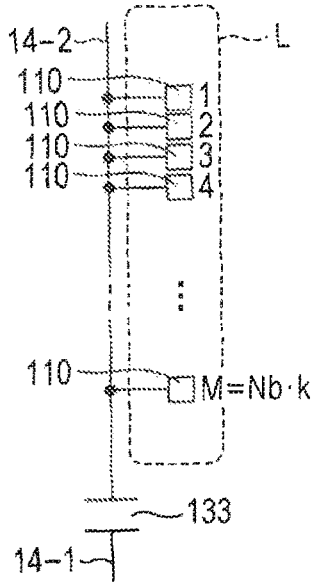
FIG. 6 is a diagram illustrating a configuration of the related art that is illustrated as a comparison example.

In contrast to this, a configuration of the related art is illustrated in FIG. 6. FIG. 6 is a diagram illustrating a configuration of the related art which is illustrated as a comparison example. As illustrated in FIG. 6, in the configuration of the related art, the second data transfer line 14-2 is provided in the pixel string L, and the transfer capacitor 133 and the first data transfer line 14-1 are provided on an end portion of the second data transfer line 14-2. That is, in the configuration of the related art, one first data transfer line 14-1 and one second data transfer line 14 are provided in one pixel string L (all the pixel circuits 110 are included in the pixel string L). This point is clearly different from a point in which, in the present embodiment described with reference to FIG. 5, a specific configuration, that is, the second data transfer line 14-2, is divided in the block B units which configure the pixel strings L and thereby a plurality of the second data transfer lines 14-2 are provided.

However, as represented by the following (expression 1), a value which is obtained by dividing the number M of all the rows of the pixel circuits 110 in the display unit 10 by the number Nb of the rows of the pixel circuits 110 which are coupled to one second data transfer line 14-2 is referred to as K. In other words, it is assumed that the second data transfer lines 14-2 are divided into K pieces which are values that are obtained by dividing M by Nb, and Nb pixel circuits 110 are coupled to one second data transfer line 14-2.

Expression 1

$$K = \frac{M}{Nb} \tag{1}$$

In the present embodiment, K(K≥2) second data transfer lines 14-2 are provided to the first data transfer line 14-1. In other words, one pixel string L includes K blocks B. In addition, the first data transfer line 14-1 is provided so as to correspond to the pixel circuits 110 of M rows (M pieces), and the second data transfer lines 14-2 are provided so as to correspond to the pixel circuits 110 of Nb rows (Nb pieces). Thus, second data transfer line 14-2 is shorter than the first data transfer line 14-1.

In the present embodiment, the value of Nb is 2. k is used as an arbitrary integer which is equal to or greater than 1 and is equal to or less than K.

Hereinafter, as illustrated in FIG. 4, the first transistor 126 corresponding to blocks that include the first block and the second block is set as the first transistor 126 which is a kth transistor when counted from the first, and a control signal Gfix(k) is supplied to the first transistor 126.

The pixel circuit 110 includes a P-channel MOS transistors 121 to 125, an OLED 130, and a pixel capacitor 132. The scan signal Gwr(m) and the control signal Gcmp(m), Gel(m), and Gorst(m) are supplied to the pixel circuit 110 of mth row. Here, the scan signal Gwr(m) and the control signal Gcmp(m), Gel(m), and Gorst(m) are respectively supplied by the scan line drive circuit 20 in correspondence with the mth row.

While not illustrated in FIG. 2, as illustrated in FIG. 4, control lines 143 (first control lines) of M rows which extend in a horizontal direction (X direction), control lines 144 (second control lines) of M rows which extend in the horizontal direction, control lines 145 (third control lines) of M rows which extend in the horizontal direction, and control lines 146 (fourth control lines) of Kth rows which extend in the horizontal direction are provided in the display panel 2 (display unit 100).

Then, the scan line drive circuit 20 supplies the control line 143 of the mth row with the control signal Gcmp(m), supplies the control line 144 of the mth row with the control signal Gel(m), supplies the control line 145 of the mth row with the control signal Gorst(m), and supplies the control line 146 of the kth row with the control signal Gfix(k).

That is, the scan line drive circuit 20 respectively supplies the pixel circuit which is positioned in the mth row with the scan signal Gwr(m) and the control signals Gel(m), Gcmp (m), and Gorst(m), via the scan line 12 and the control lines 143, 144, and 145 which are mth rows. In addition, the scan line drive circuit 20 supplies the first transistor 126 which is positioned in the kth row with the control signal Gfix(k) via the control line 146 of the kth row.

Hereinafter, there is a case in which the scan line 12, the control line 143, the control line 144, the control line 145, and the control line 146 are comprehensively referred to as a "control line". That is, in the display panel 2 according to the present embodiment, four control lines including the scan line 12 are provided in each row, and one control line 146 is provided in each Nb row.

The pixel capacitor 132 and the transfer capacitor 133 respectively includes two electrodes. The transfer capacitor 133 is a capacitor which includes the first electrode 133-1 and the second electrode 133-2.

A gate of the second transistor 122 is electrically coupled to the scan line 12 of the mth row, and one of a source and a drain of the second transistor 122 is electrically coupled to the second data transfer line 14-2. In addition, the other of the source and the drain of the second transistor 122 is respectively and electrically coupled to a gate of the drive transistor 121 and one electrode of the pixel capacitor 132. That is, the second transistor 122 is electrically coupled between the gate of the drive transistor 121 and the second electrode 133-2 of the transfer capacitor 133. Then, the second transistor 122 functions as a transistor that controls electrical coupling between the gate of the drive transistor 121 and the second electrode 133-2 of the transfer capacitor 133 which is coupled to the second data transfer line 14-2 of the (3n−2)th row.

A source of the drive transistor 121 is electrically coupled to a power supplying line 116, and a drain of the drive transistor 121 is electrically coupled to one of a source and a drain of a third transistor 123, and a source of a fourth transistor 124.

Here, a potential Vel which is on a high side of a power supply in the pixel circuit 110 is supplied to the power supplying line 116. The drive transistor 121 functions as a drive transistor in which a current according to a voltage between the gates and the source of the drive transistor 121 flows.

A gate of the third transistor 123 is electrically coupled to the control line 143, and the control signal Gcmp(m) is supplied to the gate of the third transistor 123. The third transistor 123 functions as a switching transistor which controls electrical coupling between the gate and the drain of the drive transistor 121. Thus, the third transistor 123 is a transistor for conducting the gate-source of the drive transistor 121 via the second transistor 122. The second transistor 122 is coupled between one of the source and the drain of the third transistor 123 and the gate of the drive transistor 121, but one of the source and the drain of the third transistor 123 can also be interpreted to be electrically coupled to the gate of the drive transistor 121.

A gate of the fourth transistor 124 is electrically coupled to the control line 144, and the control signal Gel(m) is supplied to the gate of the fourth transistor 124. In addition, a drain of the fourth transistor 124 is electrically coupled to a source of the fifth transistor 125 and an anode 130*a* of the OLED 130. The fourth transistor 124 functions as a switching transistor that controls electrical coupling between the drain of the drive transistor 121 and the anode of the OLED 130. Furthermore, the fourth transistor 124 is coupled between the drain of the drive transistor 121 and the anode of the OLED 130, but the drain of the drive transistor 121 can also be interpreted to be electrically coupled to the anode of the OLED 130.

A gate of the fifth transistor 125 is electrically coupled to the control line 145, and the control signal Gorst is supplied to the gate of the fifth transistor 125. In addition, a drain of the fifth transistor 125 is electrically coupled to a power supplying line 16 of the (3n−2)th row, and is maintained as a reset potential Vorst. The fifth transistor 125 functions as a switching transistor that controls electrical coupling between the power supplying line 16 and the anode 130*a* of the OLED 130.

A gate of the first transistor 126 is electrically coupled to the control line 146, and the control signal Gfix(k) is supplied to the gate of the first transistor 126. In addition, one of a source and a drain of the first transistor 126 is electrically coupled to the second data transfer line 14-2, and is electrically coupled to the second electrode 133-2 of the transfer capacitor 133 and the other of the source and the drain of the third transistor 123 via the second data transfer line 14-2. In addition, the other of the source and the drain of the first transistor 126 is electrically coupled to the first data transfer line 14-1 of the (3n−2)th row.

The first transistor 126 mainly functions as a switching transistor that controls electrical coupling between the first data transfer line 14-1 and the second data transfer line 14-2.

Here, the first transistor 126 and the transfer capacitor 133 are commonly used by the Nb pixel circuits 110 that are coupled to the same second data transfer lines 14-2. In the present embodiment, as illustrated in FIG. 4, the first transistor 126 and the transfer capacitor 133 are commonly used by two pixel circuits 110 which are the pixel circuit 110 of the m1th row and the pixel circuit 110 of the m2th row.

The display panel 2 in the present embodiment is formed on a silicon substrate, and thus substrate potentials of the transistors 121 to 126 are set as a potential Vel. In addition, the sources and drains of the transistors 121 to 126 may be interchanged with each other depending on a channel type of the transistors 121 to 126 and a relationship of potentials. In addition, the transistors may be thin film transistors and may be field effect transistors.

One electrode of the pixel capacitor 132 is electrically coupled to the gate of the drive transistor 121, and the other electrode of the pixel capacitor 132 is electrically coupled to the power supplying line 116. For this reason, the pixel capacitor 132 functions as a retention capacitor that retains a gate-source voltage of the drive transistor 121. A capacitance value of the pixel capacitor 132 is referred to as Cpix.

As the pixel capacitor 132, a capacitor that parasitizes in the gate of the drive transistor 121 may be used, and a capacitor that is formed by interposing an insulating layer bet conductive layers different from each other in a silicon substrate may be used.

The anode 130*a* of the OLED 130 is a pixel electrode that independently provided for each pixel circuit 110. In contrast to this, a cathode of the OLED 130 is a common electrode 118 that is commonly provided across all the pixel circuits 110, and is maintained as a potential Vct which is on a low side of the power supply, in the pixel circuit 110. The OLED 130 is an element in which a white organic EL layer is interposed between the anode 130*a* and the cathode with optical transparency, in the silicon substrate. Then, a color filter corresponding to one of RGB overlaps an emission side (cathode side) of the OLED 130. A cavity structure may be formed and a wavelength of light that is emitted from the OLED 130 may be set, by adjusting an optical distance between two reflection layers in which a white organic EL layer is disposed so as to be interposed between the two reflection layers. In this case, a color filer may be used and may not be used.

In the OLED 130, if a current flows from the anode 130*a* to the cathode, holes that are injected from the anode 130*a* and electrons that are injected from the cathode are recombined together in an organic EL layer, and thereby excitons are generated and white light is generated. The white light generated at this time is configured so as to pass through the cathode on a side opposite to a silicon substrate (anode 130*a*) via coloration performed by a color filter and to be viewed by an observer.

Figure 7:
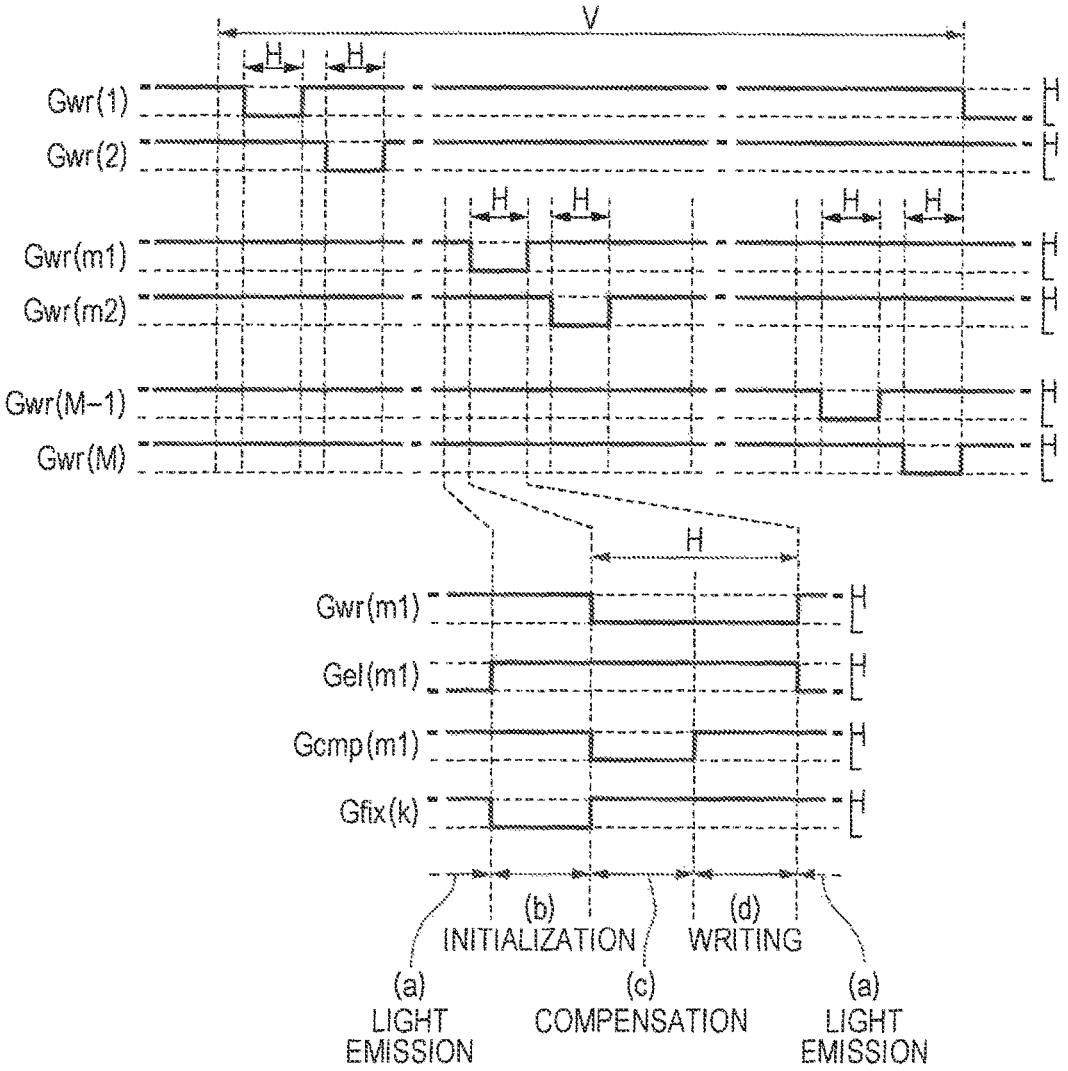
FIG. 7 is a timing chart illustrating an operation of the electro-optical device.

An operation of the electro-optical device 1 will be described with reference to FIG. 7. FIG. 7 is a timing chart illustrating operations of each unit in the electro-optical device 1. As illustrated in FIG. 7, the scan line drive circuit 20 sequentially switches the scan signals Gwr(1) to Gwr(M) in an L level, and sequentially scans the scan lines 12 of the first to Mth rows for each horizontal scan period (H), during one frame period.

Operations in one horizontal scan period (H) are common across the pixel circuits 110 of each row. Thus, hereinafter, in a horizontal scan period in which the m1th row is horizontally scanned, an operation will be described particularly with focus on the pixel circuit 110 of m1th row and (3n−2)th column.

In the present embodiment, the horizontal scan period of the m1 row is roughly divided into a compensation period denoted by (c) in FIG. 7, and writing period denoted by (d) in FIG. 7. In addition, periods other than the horizontal scan period are divided into a light emission period denoted by (a), and an initialization period denoted by (b). Then, after the writing period (d), the period again becomes the light emission period denoted by (a), and after one frame period passes, the period again becomes the horizontal scan period of the m1 row. For this reason, in terms of the sequence of time, a cycle of the light emission period, the initialization period, the compensation period, the writing period, and the light emission period is repeated.

Figure 8:
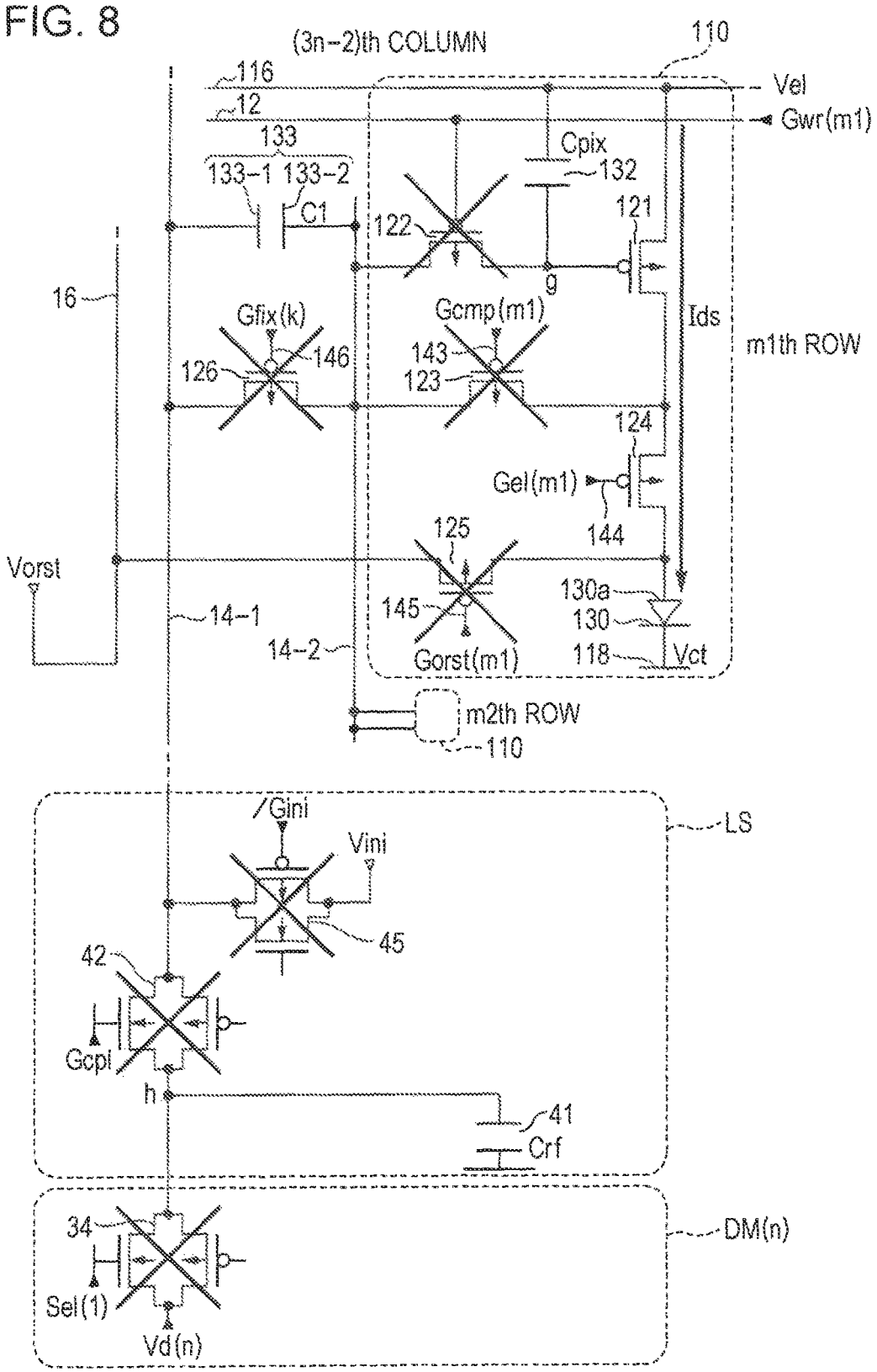
FIG. 8 is a first operation explanatory diagram of the electro-optical device.

Hereinafter, for convenience of description, the light emission period with a prerequisite of the initialization period will be described. FIG. 8 is diagram illustrating an operation of the pixel circuit 110 or the like in the light emission period. In FIG. 8, a current path which is important for operation description is denoted by a bold line, and "X" is boldly marked on transistors or transmission gates which are in an OFF state (this applies in the same manner to the following FIG. 9, FIG. 11, and FIG. 12).

Light Emission Period

As illustrated in the timing chart of FIG. 7, in the light emission period of the m1th row, the scan signal Gwr(m1) is in an H level, the control signal Gel(m1) is in an L level, the control signal Gcmp(m1) is in an H level, and the control signal Gfix(k) is in an H level.

For this reason, as illustrated in FIG. 8, in the pixel circuit 110 of the m1th row and the (3n−2)th column, while the fourth transistor 124 is turned on, the transistors 122, 123, 125, and 126 are turned off. As a result, the drive transistor 121 supplies the OLED 130 with a voltage which is retained in the pixel capacitor 132, that is, a drive current Ids according to a gate-source voltage Vgs. That is, the OLED 130 receives a current, which is supplied by the drive transistor 121, according to a gradation potential according to a designated gradation of each pixel, and emits light in brightness according to the current.

Here, in the level shift circuit LS in the light emission period, since the control signal /Gini is in an H level and thereby the transmission gate 45 is turned off and the control signal Gcpl becomes an L level as illustrated in FIG. 8, the transmission gate 42 is turned off as illustrated in FIG. 8. In addition, in the demultiplexer DM(n) in the light emission period, the control signal Sel(1) is in an L level, and thereby the transmission gate 34 is turned off.

The light emission period of the m1th row is a period in which the rows other than the m1th row are horizontally scanned, and thereby the transmission gate 34, the transmission gate 42, and the transmission gate 45 are turned on or off in accordance with operations of the rows, and thus the potentials of the first data transfer line 14-1 and the second data transfer line 14-2 appropriately vary. However, n the pixel circuit 110 of the m1th row, the second transistor 122 is turned off, and thereby, here, the first data transfer line 14-1 and the second data transfer line 14-2 do not take into account the potential variation.

Initialization Period

Next, an initialization period of the m1th row starts. As illustrated in FIG. 7, in the initialization period of the m1th row, the scan signal Gwr(m1) is in an H level, the control signal Gel(m1) is in an H level, the control signal Gcmp(m1) is in an H level, and the control signal Gfix(k) is in an L level.

Figure 9:
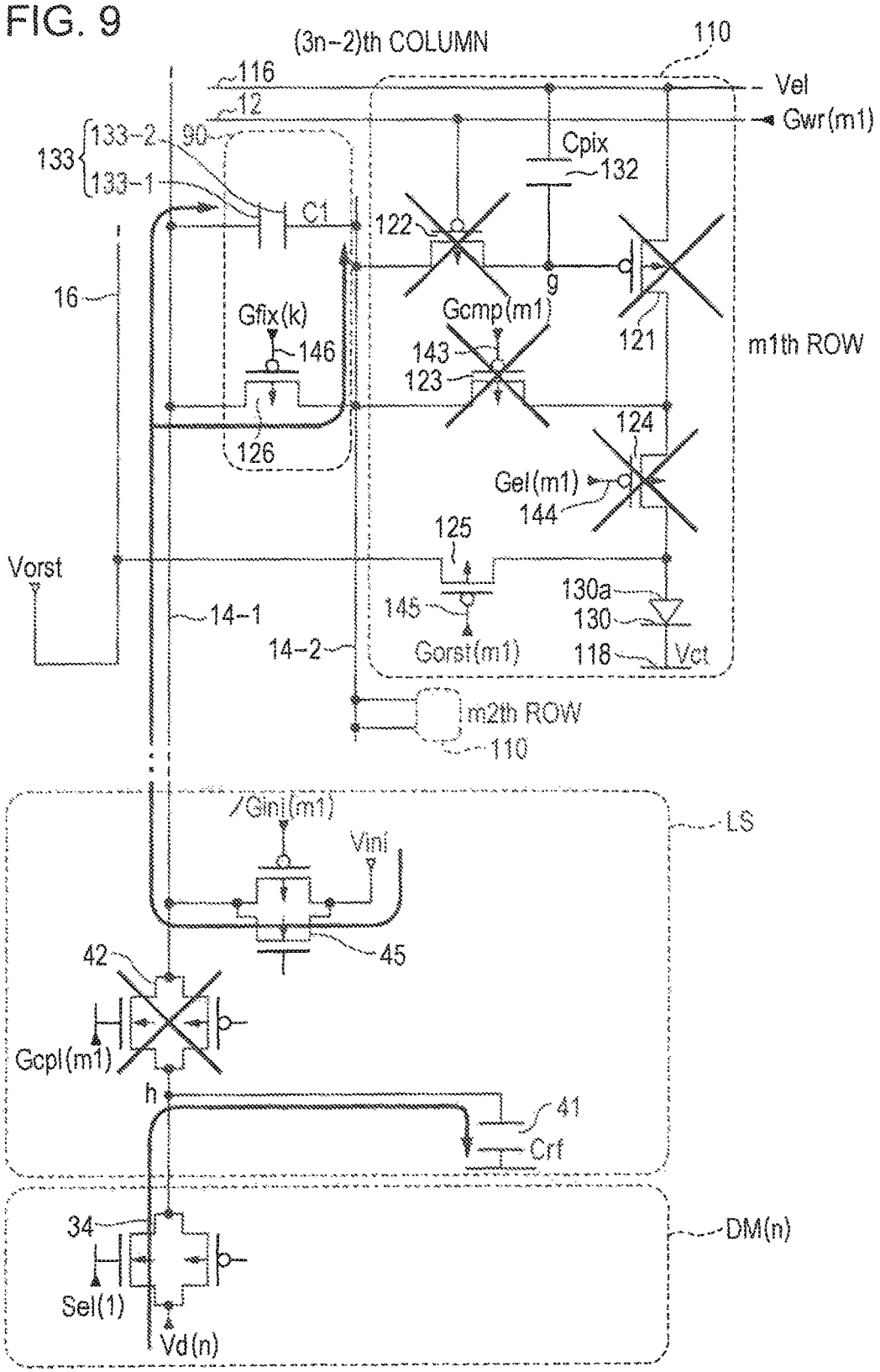
FIG. 9 is a second operation explanatory diagram of the electro-optical device.

For this reason, as illustrated in FIG. 9, in the pixel circuit 110 of the m1th row and the (3n−2)th column, while the transistors 125 and 126 are turned on, the transistors 122, 123, and 124 are turned off. As a result, a path of the current which is supplied to the OLED 130 is blocked, and thereby the OLED 130 enters an OFF (non-light-emission) state.

Here, in the level shift circuit LS in the initialization period, since the control signal /Gini is in an L level and thereby the transmission gate 45 is turned on and the control signal Gcpl becomes an L level as illustrated in FIG. 9, the transmission gate 42 is turned off as illustrated in FIG. 9. For this reason, as illustrated in FIG. 9, the first data transfer line 14-1 which is coupled to the first electrode 133-1 of the transfer capacitor 133 is set to an initial potential Vini and the first transistor 126 is turned on, and thereby the first data transfer line 14-1 and the second data transfer line 14-2 are coupled to each other, and the second electrode 133-2 of the transfer capacitor 133 is also set to the initial potential Vini. As a result, the transfer capacitor 133 is initialized.

In addition, in the demultiplexer DM(n) in the initialization period, the control signal Sel(1) is in an H level, and thereby the transmission gate 34 is turned on as illustrated in FIG. 9. As a result, a gradation potential is written to the storage capacitor 41 with a capacitance value Crf.

Figure 10:
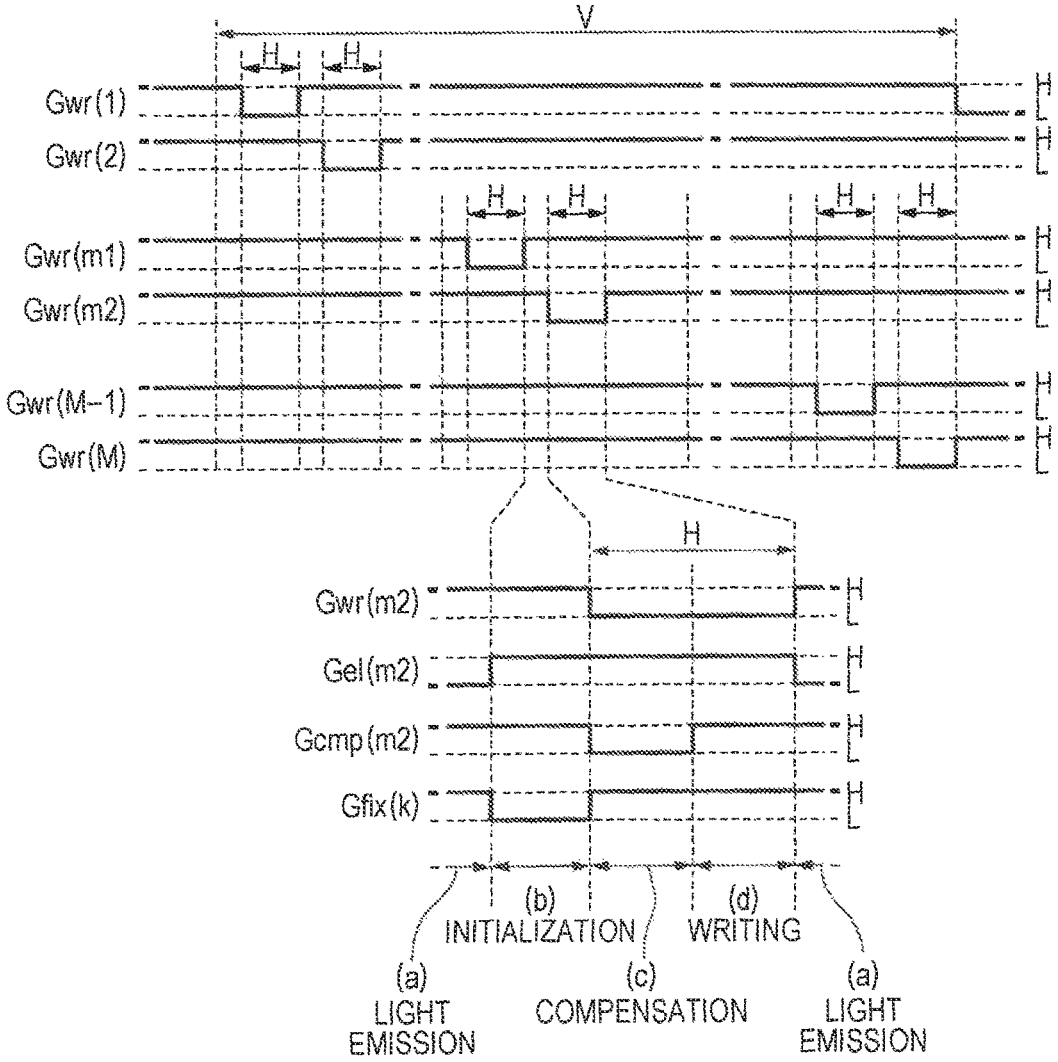
FIG. 10 is a timing chart illustrating an operation of the electro-optical device.

However, in the present embodiment, as illustrated in FIG. 9, the pixel circuit 110 of the m2th row and the (3n−2)th column is also coupled to the second data transfer line 14-2 to which the pixel circuit 110 of the m1th row and the (3n−2)th column is coupled. Thus, the first transistor 126 which is controlled by the control signal Gfix(k) that is used the initialization period of the m1th row is also used in the initialization period of the m2th row, as illustrated in FIG. 10.

Compensation Period

If the initialization period (b) described above ends, a horizontal scan period starts. To begin with, the compensation period (c) illustrated in FIG. 7 starts. In the compensation period of the m1th row, the scan signal Gwr(m1) is in an L level, the control signal Gel(m1) is in an H level, the control signal Gcmp(m1) is in an L level, and the control signal Gfix(k) is in an H level.

Figure 11:
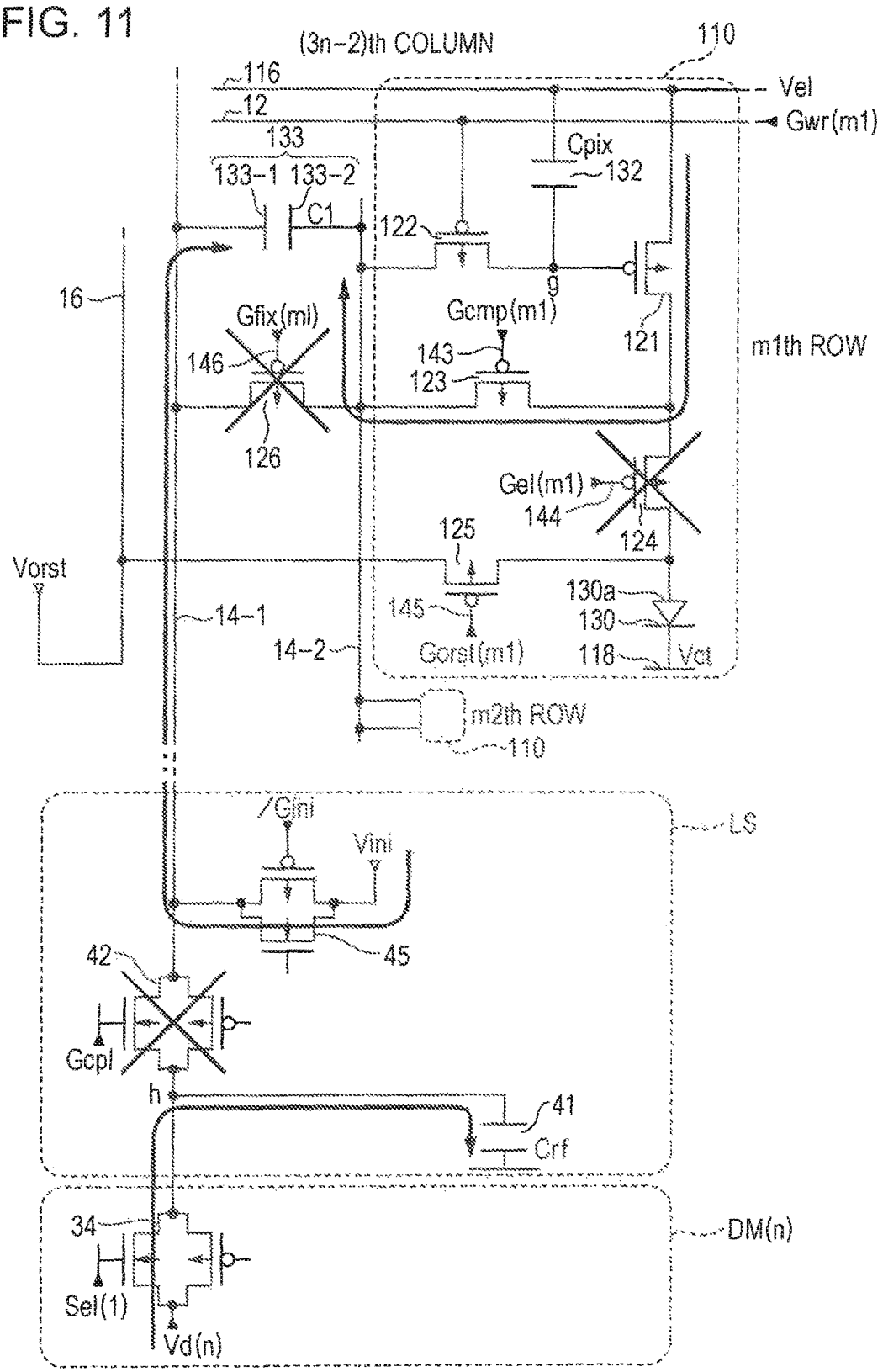
FIG. 11 is a third operation explanatory diagram of the electro-optical device.

For this reason, as illustrated in FIG. 11, in the pixel circuit 110 of the m1th row and the (3n−2)th column, while the transistors 122, 123, and 125 are turned on, the fourth transistors 124 and 126 are turned off. At this time, a gate g of the drive transistor 121 is coupled (diode-coupled) to a drain of the drive transistor 121 via the second transistor 122 and third transistor 123, and a drain current flows through the drive transistor 121, thereby charging the gate g.

That is, the drain and gate g of the drive transistor 121 are coupled to the second data transfer line 14-2. If a threshold voltage of the drive transistor 121 is referred to as Vth, a potential Vg of the gate g of the drive transistor 121 gradually approaches (Vel-Vth).

Here, in the level shift circuit LS in the compensation period, since the control signal /Gini is in an L level and thereby the transmission gate 45 is turned on and the control signal Gcpl becomes an L level as illustrated in FIG. 11, the transmission gate 42 is turned off as illustrated in FIG. 11. At this time, the second data transfer line 14-2 is shortened compared to the configuration of the related art as described above, and thus a time required for charging or discharging of a parasitic capacitor accompanying the second data transfer line 14-2 is reduced, and the compensation period is shortened.

In addition, in the demultiplexer DM(n) in the compensation period, the control signal Sel(1) is in an H level, and thereby the transmission gate 34 is turned on as illustrated in FIG. 11. As a result, a gradation potential is written to the storage capacitor 41 with a capacitance value Crf.

Since the fourth transistor 124 is turned off, the drain of the drive transistor 121 is electrically decoupled to the OLED 130. In addition, in the same manner as in the initialization period, the fifth transistor 125 is turned on, and thereby the anode 130*a* of the OLED 130 and the power supplying line 16 are electrically coupled to each other, and a potential of the anode 130*a* is set to a reset potential Vorst.

Writing Period

In the horizontal scan period of the m1th row, if the compensation period (c) described above ends, the writing period (d) starts. In the writing period of the m1th row, the scan signal Gwr(m1) is in an L level, the control signal Gel(m1) is in an H level, the control signal Gcmp(m1) is in an H level, and the control signal Gfix(k) is in an H level.

Figure 12:
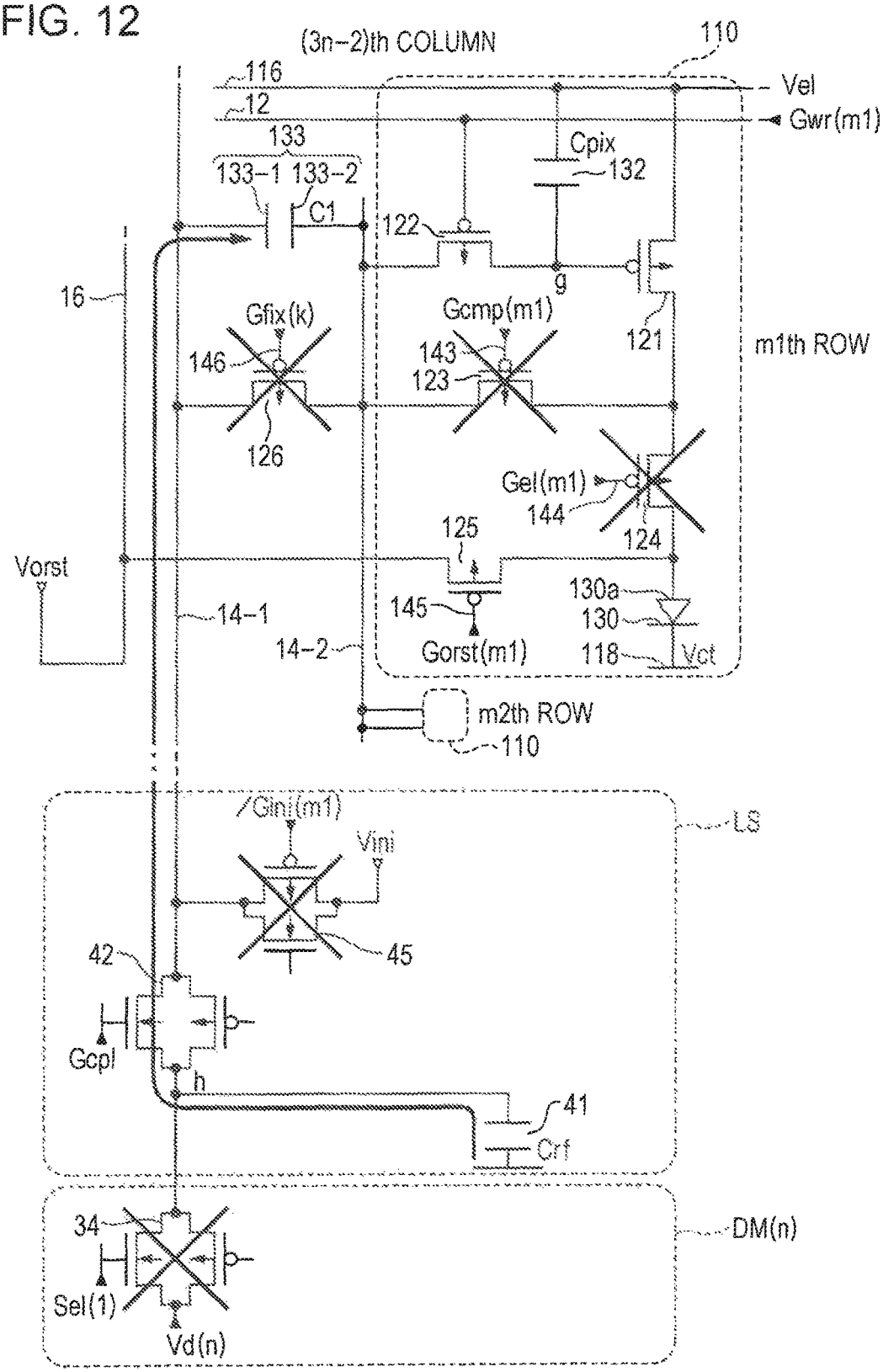
FIG. 12 is a fourth operation explanatory diagram of the electro-optical device.

For this reason, as illustrated in FIG. 12, in the pixel circuit 110 of the m1th row and the (3n−2)th column, while the transistors 122 and 125 are turned on, the transistors 123, 124, and 126 are turned off.

Here, in the level shift circuit LS in the writing period, since the control signal /Gini is in an H level and thereby the transmission gate 45 is turned off and the control signal Gcpl becomes an H level as illustrated in FIG. 12, the transmission gate 42 is turned on as illustrated in FIG. 12. For this reason, supplying of the initial potential Vini to the first data transfer line 14-1 and the first electrode 133-1 is released, one electrode of the storage capacitor 41 with the capacitance value Crf is coupled to the first data transfer line 14-1 and the first electrode 133-1, and a gradation potential is supplied to the first electrode 133-1. Thus, a signal which is generated by level-shifting the gradation potential is supplied to the gate of the drive transistor 121 and is written to the pixel capacitor Cpix.

In the demultiplexer DM(n) in the writing period, the control signal Sel(1) is in an L level, and thereby the transmission gate 34 is turned off as illustrated in FIG. 12.

Since the fourth transistor 124 is turned off, the drain of the drive transistor 121 is electrically decoupled to the OLED 130. In addition, in the same manner as in the initialization period, the fifth transistor 125 is turned on, and thereby the anode 130*a* of the OLED 130 and the power supplying line 16 are electrically coupled to each other, and a potential of the anode 130*a* is set to a reset potential Vorst.

In the writing period of the mth row, in terms of an nth group, the control circuit 3 sequentially switches the data signal Vd(n) to potentials according to gradation levels of the pixels of the mth row and the (3n−2) column, the mth row and the (3n−1)th column, and the mth row and (3n)th column.

Meanwhile, the control circuit 3 sequentially and exclusively sets the control signals Sel(1), Sel(2), and Sel(3) to an H level, in accordance with switching of the potentials of the data signals. While not illustrated, the control circuit 3 also outputs the control signals /Sel(1), /Sel(2), and /Sel(3) which are in a relationship of logical inversion with the control signals Sel(1), Sel(2), and Sel(3). According to this, in the demultiplexer DM, the transmission gates 34 in each group are respectively turned on in a sequence of the left column, the central column, and the right column.

However, if, when the transmission gate 34 of the left column is turned on by the control signals Sel(1) and /Sel(1), a potential change amount of the first data transfer line 14-1 and the first electrode 133-1 is referred to as ΔV, and the second data transfer line 14-2 and a potential change amount ΔVg of the gate g of the drive transistor 121 are represented by the following (expression 2). However, the capacitance value C1 of the transfer capacitor 133 can be adjusted in proportional to the number of rows of the pixel circuit 110, and is set to a capacitance C1*a* per row. In addition, a capacitance value of a parasitic capacitor accompanying the second data transfer line 14-2 is set to C3*a* per row. In addition, as described above, the number of rows of the pixel circuit 110 which is coupled to one second data transfer line 14-2 is referred to as Nb.

$$\Delta Vg = \frac{Nb \cdot C1a}{Nb \cdot C1a + Nb \cdot C3a + Cpix} \Delta V \tag{2}$$

Here, a ratio of ΔV and ΔVg is set as a compression rate R as represented by the following expression 3.

$$R = \frac{Nb \cdot C1a}{Nb \cdot C1a + Nb \cdot C3a + Cpix} \tag{3}$$

That is, the potential Vg of the gate of the drive transistor 121 in the writing period is a value which is level-shifted (data-compressed) from the potential Vg in the compensation period by a value that is obtained by multiplying the potential change amount ΔV of the first data transfer line 14-1 and the first electrode 133-1, and R together. If the writing period ends, the light emission period (a) described above starts.

It can be seen from a relationship represented by Expression 2 described above that the greater the number Nb of the pixel circuits 110 which are coupled to the second data transfer line 14-2 is (the greater the number Nb of the pixel circuits 110 included in one block is), the closer values ΔVg and ΔV become. In other words, the greater a value of Nb is, the more R represented by Expression 4 approaches 1.

Here, it is preferable that the number Nb of the pixel circuits 110 (the number Nb of the pixel circuits 110 included in one block) which are coupled to the second data transfer line 14-2 is determined by taking into account a time required for completing a compensation operation, and a compression rate of data compression. Hereinafter, a specific description will be made.

To begin with, a time required for completing the compensation operation will be described. It is preferable that the potential Vg (compensation point) of the gate g of the drive transistor 121 at a time point in which the compensation period is completed is set to an intermediate gradation of a gradation voltage, and the smaller the value of Nb is, the smaller a parasitic capacitor accompanying the gate g of the drive transistor 121 is, and thereby the compensation period is extremely shortened. As a result, there is a possibility that, by an influence of rounding at rising edge (falling edge) of the scan signal Gwr(m), the compensation periods on a side which supplies the scan signal Gwr(m) and a side which receives the scan signal Gwr(m) are different from each other. In this case, the scan line drive circuit 20 with a high drive capability enough to eliminate the possibility is required.

In addition, with regard to a compression rate of data compression, as represented by Expression 2, the smaller the value of Nb is, the greater the compression rate is, and conversely, the greater the value of Nb is, the smaller the compression rate is.

Thus, it is preferable that the value of Nb is set to an appropriate value by taking into account the time required for completing the compensation period and the compression rate of data compression. For example, in a case in which the total number of rows N is 720, Nb may be 90 and the total number of blocks K may be 8.

As described above, according to one embodiment of the invention, speed-up of a compensation operation of compensating variation of the threshold voltage of a transistor which is used for adjustment of a light emission intensity is realized, and thereby it is possible to provide an electro-optical device, an electronic apparatus, and a method of driving the electro-optical device.

The invention is not limited to the embodiments described above, and for example, various modifications which will be described hereinafter can be made. In addition, forms of modification which will be described hereinafter can be combined with one or more of the forms which are arbitrarily selected.

Modification Example 1

Figure 13:
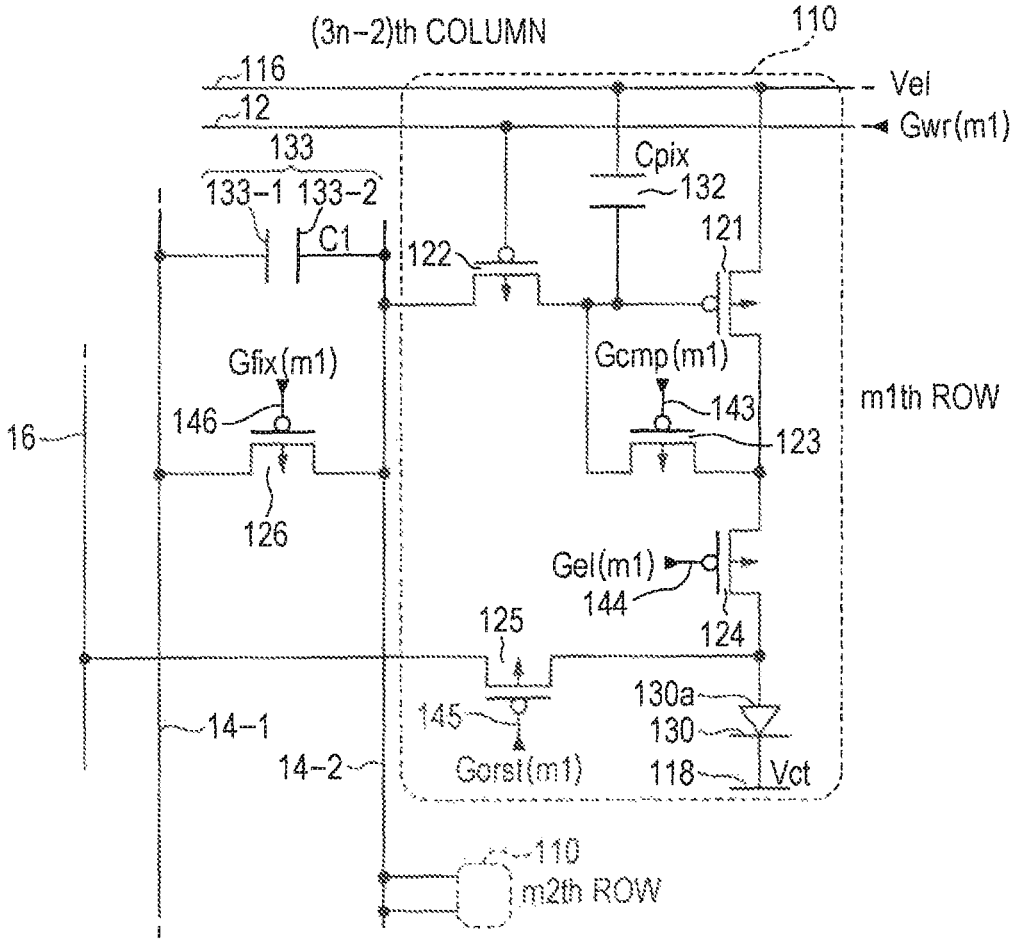
FIG. 13 is a circuit diagram illustrating a configuration of a pixel circuit according to a modification example.

In the embodiments described above, the third transistor 123 is coupled between a drain of the drive transistor 121 and the second data transfer line 14-2, in each pixel circuit 110, but the third transistor 123 may be coupled between the drain and the gate g of the drive transistor 121, as illustrated in FIG. 13.

Modification Example 2

In each pixel circuit 110 in the embodiments described above, the fifth transistor 125 may not be provided.

Modification Example 3

It is not necessary for the first transistor 126 described above to be disposed outside the pixel circuit 110, and the first transistor 126 may be disposed inside each pixel circuit 110.

Modification Example 4

In the embodiments described above, the first transistors 126 and the transfer capacitors 133 are provided for two pixel circuits 110, but the second data transfer line 14-1, the first transistor 126, and the transfer capacitor 133 may be provided so as to correspond one-to-one to each of the pixel circuits 110.

Modification Example 5

The embodiments described above are configured in such a manner that the first data transfer lines 14-1 are grouped for the three respective columns, the first data transfer lines 14-1 are sequentially selected in each group, and a data signal is supplied to the selected lines, but the number of data lines which configure the group may be a predetermined number which is equal to or greater than "2" and equal to or smaller than "3n". For example, the number of data lines which configure the group may be "2" and may be equal to or greater than "4".

In addition, without grouping, that is, without using the demultiplexer DM, the embodiments may be configured so as to simultaneously and sequentially supply the data signals to the first data transfer lines 14-1 of each column.

Modification Example 6

In the embodiments described above, the transistors 121 to 126 are all P-channel types, but may all be N-channel types. In addition, P-channel type transistors and N-channel type transistors may be appropriately combined.

For example, in a case in which the transistors 121 to 126 are all N-channel types, the data signal Vd(n) of the embodiments described above may be supplied to each pixel circuit 110 as a potential, polarity of which is reversed. In this case, the sources and the drains of the transistors 121 to 126 are in a relationship of being reversed to those of the embodiments and modification examples which are described above.

Modification Example 7

In the embodiments and modification examples which are described above, an example is described in which an OLED that is a light emitting element is used as an electro-optical element, but the electro-optical element may be an element which emits light in brightness according to a current, such as an inorganic light emitting diode or a light emitting diode (LED).

Application Example

Next, an electronic apparatus to which the electro-optical device 1 according to an embodiment, an application example, or the like is applied will be described. In the electro-optical device 1, the pixels are directed to a high definition display with a small size. However, an example in which a head-mounted display is used as an electronic device will be described.

Figure 14:
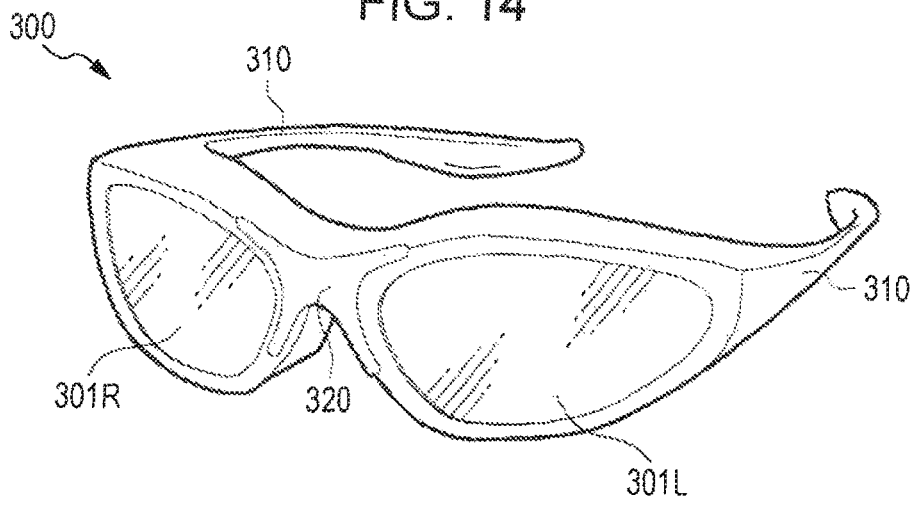
FIG. 14 is a diagram illustrating an external configuration of an HMD.
Figure 15:
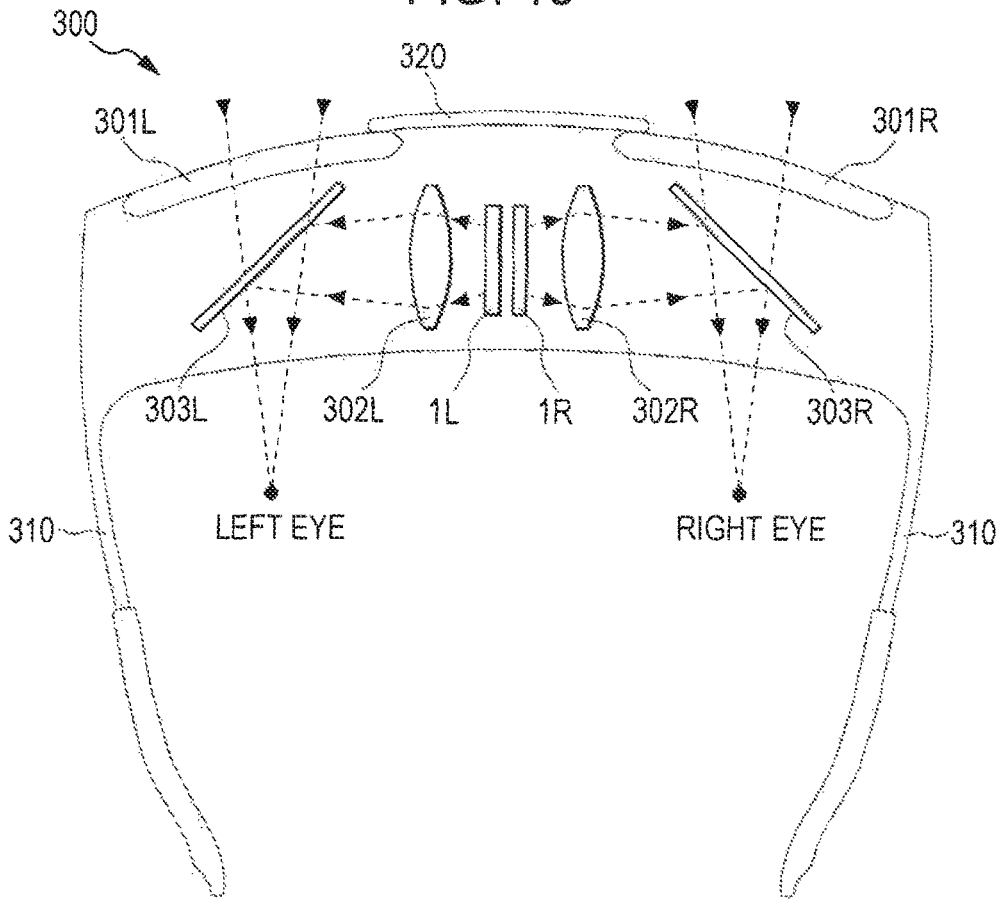
FIG. 15 is a diagram illustrating an optical configuration of the HMD.

FIG. 14 is a diagram illustrating an appearance of a head-mounted display, and FIG. 15 is a diagram illustrating an optical configuration of the head-mounted display.

To begin with, as illustrated in FIG. 14, the head-mounted display 300 includes a temple 310, a bridge 320, and lenses 301L and 301R, in the same manner as in an eyeglasses, in appearance. In addition, as illustrated in FIG. 15, in the head-mounted display 300, an electro-optical device 1L for the left eye and an electro-optical device 1R for the right eye are provided on a far side (lower side in the figure) of the lenses 301L and 301R in the vicinity of the bridge 320.

A pixel display surface of the electro-optical device 1L is disposed so as to be positioned on the left side of FIG. 15. According to this, a display image formed by the electro-optical device 1L is emitted in a nine o'clock direction in the figure via an optical lens 302L. While reflecting a display image formed by the electro-optical device 1L in a six o'clock direction, a half mirror 303L makes light which is incident in a twelve o'clock direction pass through.

An image display surface of the electro-optical device 1R is disposed so as to be positioned on the right side opposite to that of the electro-optical device 1L. According to this, a display image formed by the electro-optical device 1R is emitted in a three o'clock direction in the figure via an optical lens 302R. While reflecting a display image formed by the electro-optical device 1R in a six o'clock direction, a half mirror 303R makes light which is incident in a twelve o'clock direction pass through.

In this configuration, a wearer of the head-mounted display 300 can observe display images formed by the electro-optical devices 1L and 1R, in a see-through state in which the display images overlap external appearances.

In addition, in the head-mounted display 300, if an image for the left eye is displayed on the electro-optical device 1L and an image for the right eye is displayed on the electro-optical device 1R, among binocular images with parallax, an image which is displayed can be perceived to the wearer as if having a depth and a three-dimensional appearance (3D display).

The electro-optical device 1 can also be applied to an electronic viewfinder in a video camera, a digital camera of an interchangeable lens type, or the like, in addition to the head-mounted display 300.

The entire disclosure of Japanese Patent Application No. 2014-160135, filed Aug. 6, 2014 is expressly incorporated by reference herein.

What is claimed is:

1. An electro-optical device comprising:

a first data transfer line;

a second data transfer line;

a first capacitor that includes a first electrode which is coupled to the first data transfer line and a second electrode which is coupled to the second data transfer line;

a drive transistor;

a compensation transistor that outputs a potential according to electrical characteristics of the drive transistor to the second electrode and the second data transfer line in the compensation period when a gate of the drive transistor is electrically coupled to a drain of the drive transistor via the compensation transistor;

a data transfer line driver circuit that switches potentials of the first data transfer line and the first electrode, in such a manner that potential change amounts of the first data transfer line and the first electrode becomes a value according to a gradation level; and a light emitting element that emits light in brightness according to a magnitude of a current which is supplied based on a potential that is shifted in accordance with the potential change amounts from a potential according to the electrical characteristics of the drive transistor, wherein each of the plurality of second data transfer lines is respectively coupled to the first data transfer line via a respective first capacitor of the plurality of first capacitors, wherein each of a plurality of groups of pixel circuits is coupled to different second data transfer lines, the second data transfer lines being coupled to the same first data transfer line via different first capacitors, the plurality of groups being referred to as a pixel string, and the number of the pixel circuits coupled to each of the second data transfer lines is less than the number of the pixel circuits included in the pixel string, wherein the first data transfer line is provided in correspondence with M pixels, and wherein the second data transfer line is divided into K pieces that are values obtained by dividing M by Nb, and Nb pixels are coupled to one second data transfer line, M, K and Nb each being an integer greater than or equal to 1.

2. The electro-optical device according to claim 1, further comprising:

a first transmission gate of which a output terminal is connected to the first data transfer line;

a second transmission gate of which a output terminal is connected to the output terminal of the first transmission gate; and a second capacitor of which one electrode is electrically coupled to an input terminal of the second transmission gate.

3. An electronic apparatus comprising the electro-optical device according to claim 1.

4. An electronic apparatus comprising the electro-optical device according to claim 2.

* * * * *